US005086530A

United States Patent [19]

Blake

[11] Patent Number: 5,086,530

[45] Date of Patent: * Feb. 11, 1992

[54] QUICK-CHANGE SHEET

[76] Inventor: Bonnae C. Blake, 2781 Collins Rd., Fort Mill, S.C. 29715

[ * ] Notice: The portion of the term of this patent subsequent to May 8, 2007 has been disclaimed.

[21] Appl. No.: 581,671

[22] Filed: Sep. 13, 1990

Related U.S. Application Data

[63] Continuation of Ser. No. 134,995, Dec. 18, 1987, abandoned.

[51] Int. Cl.[5] ..... A47G 9/04

[52] U.S. Cl. ..... 5/484; 5/496; 5/500; 5/502

[58] Field of Search ..... 5/484, 486, 487, 496–502

[56] References Cited

U.S. PATENT DOCUMENTS

| | | | |
|---|---|---|---|
| 2,963,715 | 12/1960 | Young | 5/484 X |
| 3,530,487 | 9/1970 | Beer | 5/496 |
| 3,570,026 | 3/1971 | Allison | 5/486 |
| 3,761,973 | 10/1973 | Leventhal | 5/484 |
| 3,965,503 | 6/1976 | Gridel | 5/484 |
| 4,499,131 | 2/1985 | Knox | 5/484 X |
| 4,922,565 | 5/1980 | Blake | 5/484 |

*Primary Examiner*—Michael F. Trettel
*Attorney, Agent, or Firm*—Clifton Ted Hunt

[57] ABSTRACT

A quick-change sheet has a top panel that is moisture proof and a bottom panel that includes portions extending under a mattress to anchor the sheet in use. The moisture proof top panel has a moisture proof layer and a soft fabric layer overlying the moisture proof layer. The two layers are joined together to form an integrated structure defining the top panel. Releasable fasteners connect the top and bottom panels and are arranged to be accessible so the top panel can be removed and replaced without disturbing either the bottom panel or the mattress.

2 Claims, 1 Drawing Sheet

QUICK-CHANGE SHEET

CROSS REFERENCE TO RELATED APPLICATION

This application is a continuation of my co-pending patent application Ser. No. 134,955, Dec. 18, 1987 for QUICK-CHANGE CRIB SHEET, now abandoned.

FIELD OF THE INVENTION

This invention relates to a quick-change sheet for a crib or a bed.

BACKGROUND OF THE INVENTION

The sheet on a crib for a small infant is usually changed several times a day. A conventional crib sheet is made from cotton or a blend of cotton and synthetic yarns and may be a fitted or contour sheet with pockets at the ends of the sheet to be fitted around the ends of the mattress, or a rectangular sheet with edge portions to be tucked under the mattress to present a smooth, comfortable upper surface of the sheet.

A crib mattress is surrounded by an enclosure defined by end panels and side rails which may extend eighteen inches or more above the mattress. It is necessary to lift portions of the mattress above the crib enclosure every time the sheet is changed in order to smooth the upper surface of the sheet by anchoring edge portions of the sheet under the mattress. The lifting of the mattress to install a clean sheet is frequently complicated by bumper pads resting on the edges of the mattress and tied to the sides of the crib. The lifting of the mattress is laborious and time consuming when done several times a day.

The crib sheet art has been concerned with protecting the baby from wrinkled sheets and from being uncovered but none of the crib sheet art, to applicant's knowledge at the time of filing the parent application, has been concerned with reducing the time and labor required to change the sheet on an infant's crib.

U.S. Pat. No. 3,570,026, issued Mar. 16, 1971 to Allison for BABY BED SHEET WITH REMOVABLE PANEL, was cited against claims in the parent application.

Allison is concerned with reducing the time and labor required to change the sheet on an infant's crib. Toward this end, Allison provides a contoured "retainer" 14, anchored to the mattress, and a removable panel 16 releasably connected as by zippers to the retainer 14.

The retainer 14 is shaped much like the well known contoured sheets which are used as the bottom sheet on many beds today, except that it has a large rectangular opening in the portion that covers the top surface of the mattress. The removable panel is generally rectangular in shape and is designed to cover the top portion of the mattress that is exposed after retainer 14 is installed on the mattress.

Allison explains that in many cases it is desired to use a quilted absorbent pad to protect the mattress and that, with the sheet of the Allison invention, such a pad may be placed over the top of the mattress with its edges inserted underneath the retainer before the removable panel is attached to the retainer.

As Allison explains, the removable panel may become soiled one or more times a day and, when soiled, the removable panel may be removed for cleaning by releasing the zippers and a clean removable panel connected to the retainer without disturbing the mattress. In fact, the mattress need not be disturbed unless the mattress is soiled because the removable panel was used without an absorbent pad. If an absorbent pad is used underneath the removable panel, the mattress will be protected and need not be disturbed, but the pad will be soiled with the removable panel and the soiled pad will have to be independently removed from the mattress for washing and a clean absorbent pad independently replaced on the mattress before assembling a clean removable panel or sheet to the retainer.

U.S. Pat. No. 1,963,739 issued June 19, 1914 to Engel for COVER FOR BABIES' BEDS shows the use of snap hooks to releasably connect a cover to the frame of a baby's bed. Engel teaches that the cover is spread the infant and fastened to the bed in such a manner that the cover "will remain in position regardless of the maneuvering of the child, so that the child will at no time become uncovered or exposed." (lines 63–65). Engel is concerned with protecting the child and is not concerned with making it easier to change a baby's crib sheet.

U.S. Pat. No. 2,677,137 issued May 4, 1954 to Bergin for COMBINATION CRIB SHEET shows a crib sheet with upper and lower layers releasably held together along one side with a zipper which is opened to put the baby between the layers of the sheet and closed to keep the baby covered. The lower layer of Bergin's sheet includes pockets at its ends to fit over the ends of the mattress, making it necessary to lift both ends of the mattress, and making the Bergin sheet at least as difficult to change as a conventional sheet.

U.S. Pat. No. 2,567,082 issued Sept. 4, 1951 to Shuster for BABY BLANKET COMBINATION shows a sheet extending over the edges and under and around each end of the mattress with a blanket detachably secured to the sheet by a zipper. Shuster says in Column 2, lines 22 and 23, that the sheet is "quickly and easily removed for changing and laundering", but the replacement of Shuster's sheet is at least as difficult and time consuming as the replacement of a conventional crib sheet because of the need to position the ends of Shuster's sheet under the mattress.

Other art shows the use of releasable fasteners on adult bedding. U.S. Pat. No. 4,488,323 issued Dec. 18, 1984 to Colburn for BED SHEETS WITH HOOK AND LOOP FASTENERS shows loop material on the longitudinal sides of a mattress and hook material on the inner longitudinal edges of top and bottom sheets. This arrangement is subject to the same objection as a conventional sheet for baby cribs because the sides of a crib mattress are covered by the crib enclosure and are not easily accessible for use of the hook and loop fasteners of Colburn. The sides of the crib mattress would have to be lifted above the enclosure similarly to the need for lifting the ends of the mattress when installing a conventional crib sheet.

U.S. Pat. No. 4,045,832 issued Sept. 6, 1977 to DiFiorti et al. for FITTED SHEET CONSTRUCTION and U.S. Pat. No. 4,144,602 issued Mar. 20, 1979 to Fernandes for FLAT CONTOUR SHEET both show the use of hook and loop fasteners to be connected under the mattress. Again, these are subject to the same objection as the conventional sheet for use on a crib mattress because of the need to lift the mattress above the crib enclosure to fasten the hook and loop fasteners.

U.S. Pat. No. 4,241,466 issued Dec. 30, 1980 to Mendyk for SAFETY BED SHEET shows a sheet construction to prevent a child or adult from falling out of bed. The construction comprises a fitted bottom sheet and a superposed top sheet that is the same width as the bottom sheet's upper surface but is shorter than the bottom sheet. The top and bottom sheets are stitched together along one longitudinal edge of the top sheet and partially stitched together along the other longitudinal edge of the top sheet with a hook and loop fastener 23 providing a releasable connection along the remainder of the latter edge. The stitching prevents the top sheet from being removed from the bottom sheet so both sheets have to be removed for cleaning. The mattress must be lifted to put on the fitted bottom sheet, which makes the teaching of Mendyk subject to the same objection as conventional sheets for use on baby cribs.

U.S. Pat. No. 4,097,943 issued July 4, 1978 to O'Connell for ABSORBENT PAD shows adhesive strips along the longitudinal edges of an incontinence pad. The adhesive strips are releasably fastened to the bedding beneath an incontinent patient to hold the pad in place. The incontinence pad is not a part of the bedding and is discarded after a single use, no provision being made for continued use. This teaching is inappropriate for quick-change crib sheets.

SUMMARY OF THE INVENTION

It is an object of this invention to provide a quick-change crib sheet comprising a bottom anchor panel equipped for attachment to a mattress in the usual way and an easily replaceable moisture proof top panel with a soft fabric surface releasably connected to the bottom anchor panel of the quick-change sheet. When soiled, the moisture proof top panel can be easily and quickly removed for washing and replaced with a clean moisture proof top panel. This has the advantage of eliminating the additional step of having to remove, clean, and replace a separate sheet or moisture proof mattress protector, as in the prior art.

It is a further object of this invention to provide a quick change sheet of the type described wherein the moisture proof top panel comprises a first layer of moisture proof construction and a second layer of soft fabric construction overlying and interconnected with the moisture proof layer to define an integrated top panel which is moisture proof and has a soft fabric upper surface for comfort.

It is a still further object of this invention to provide a quick-change sheet of the type described wherein the bottom anchor panel and the easily replaceable moisture proof top panel are each provided with interengaging elements of quick-release fasteners, such as hook and loop fasteners.

It is a more specific object of this invention to provide a quick-change sheet of the type described wherein the quick-release fasteners are arranged to be accessible to release a soiled moisture proof panel from the bottom panel and replace it with a clean moisture proof panel without disturbing the bottom panel or the mattress, and without the need of independently removing, washing, and replacing a separate moisture proof mattress protector or sheet as in the prior art.

DETAILED DESCRIPTION OF THE INVENTION

Figures 1, 2, 3:
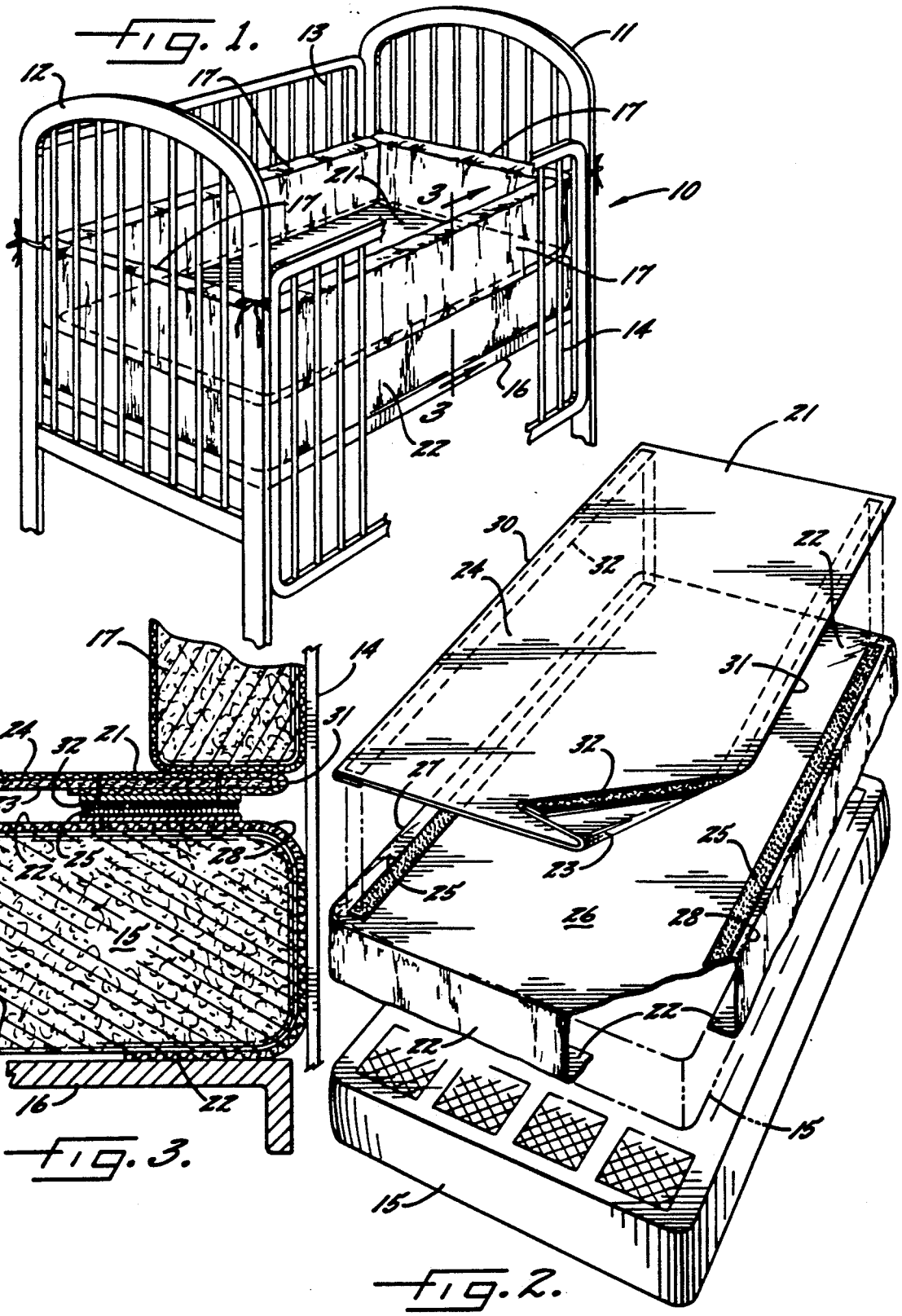
FIG. 1 is a perspective view of a baby crib, with parts broken away, illustrating the relative positions of the panels and rails defining a crib enclosure and surrounding the mattress and the bumper pads on top of the mattress.
FIG. 2 is an exploded perspective view illustrating the releasable connection of the two panels of the crib sheet and the anchoring of the bottom panel to the mattress, shown in phantom lines within the bottom panel and in solid lines beneath the bottom panel.
FIG. 3 is a sectional view taken substantially along the line 3—3 in FIG. 1.

Referring more specifically to the drawings, the numeral 10 broadly indicates a baby's crib including an enclosure defined by and end panels 11 and 12 and side rails 13 and 14 surrounding a mattress 15 supported by a frame 16. The mattress is covered by a crib sheet 20. Bumper pads 17 are supported by the mattress on top of the crib sheet 20 and against the crib enclosure.

The crib sheet 20 includes a top panel 21 and a bottom panel 22. The top panel is moisture proof and includes a moisture proof element 23 such as rubberized fabric, or the like to protect the bottom panel 22 and the mattress 15. The upper surface of the top panel is preferably formed of absorbent material, such as a soft fabric, for comfort.

The bottom panel 22 of the sheet 20 is preferably formed of a more sturdy material than conventional sheeting and is preferably in the form of a fitted contour sheet adapted to be anchored under the mattress 15, as illustrated in FIGS. 2 and 3.

The top panel 21 and the bottom panel 22 of the sheet 20 are releasably interconnected by washable, and reusable, releasable fasteners, illustrated in the preferred embodiment as being of hook and loop construction. In the illustrated embodiment, strips of hook fasteners 25 are attached to the upper surface 26 of the bottom panel 22 in inwardly spaced relation to the longitudinal upper edges 27 and 28 of the upper surface 26.

The top panel 21 is illustrated as being about the same width and length as the mattress 15, although it may be shorter than the length of the mattress if desired. It is an important feature of the invention that the cross sectional dimensions of the top panel 21 be no greater than the corresponding dimensions of the upper surface 26 of the bottom panel 22 and the mattress 15 so that the edges of the top panel 21 do not extend outwardly beyond the edges of the mattress 15.

Strips of loop fasteners 32 are spaced slightly inwardly of longitudinal marginal edges 30 and 31 of the top panel 21 in position to overlie the hook fasteners 25 on the upper surface 24 of the bottom panel 22 for releasable interengagement.

As best seen in FIG. 1, the hook fasteners 25 and 32 extend beneath the inner edges of the longitudinal bumper pads 17, making it easy to replace the frequently soiled top panel 21 by sliding the edges of a replacement top panel under the bumper pads and engaging the hook and loop fasteners without disturbing the generally protected bottom panel 22, or the bumper pads 17, or the mattress 15.

There is thus provided a quick-change sheet that enables the top panel to be removed when soiled and effectively replaced without disturbing or handling anything else, and with a minimum of effort. The less frequently soiled bottom panel may be removed and replaced in the conventional manner when necessary or desired.

Although specific terms have been employed in describing the invention, they have been used in a generic and descriptive sense only and not for the purpose of limitation.

I claim:

1. A combination mattress protector and quick-change bed sheet for use by babies and incontinent persons who frequently soil bed sheets and an underlying mattress, the combination mattress protector and quick-change bed sheet consisting of a bottom panel, a reusable top panel, and reusable means for releasably attaching the reusable top panel to the bottom panel for repeated removal and reattachment of the top panel to the bottom panel without disturbing the bottom panel or the mattress, said bottom panel including means for being anchored to a mattress in use, said top panel comprising a moisture-proof layer and an absorbent layer overlying and moisture-proof layer and integrated with the moisture-proof layer to define the top panel, said absorbent layer consisting of a single-ply layer of absorbent material, whereby the user of the sheet rests on the absorbent layer of the top panel and the moisture-proof layer of the top panel protects the bottom panel and the mattress from being soiled when the top panel is soiled, and the top panel can be removed from the bottom panel when soiled and reused by washing and reattaching the top panel to the bottom panel.

2. A quick-change sheet according to claim 1 wherein the means to connect the top panel to the bottom panel comprise hook and loop fastener registrably attached to the top and bottom panels.

* * * * *

UNITED STATES PATENT AND TRADEMARK OFFICE

CERTIFICATE OF CORRECTION

PATENT NO. : 5,086,530

DATED : February 11, 1992

INVENTOR(S) : Bonnae C. Blake

It is certified that error appears in the above-identified patent and that said Letters Patent is hereby corrected as shown below:

Column 6, line 1, change "and" (first occurrence) to --the--.

Column 6, lines 3 and 4, cancel "a single-ply layer of absorbent material" and insert in lieu thereof --the upper surface of the top panel being formed of a soft fabric--.

Signed and Sealed this

Second Day of June, 1992

*Attest:*

DOUGLAS B. COMER

*Attesting Officer*

*Acting Commissioner of Patents and Trademarks*